US006403527B1

(12) United States Patent
Horsten et al.

(10) Patent No.: US 6,403,527 B1
(45) Date of Patent: Jun. 11, 2002

(54) USE OF DIRECT THERMAL TRANSPARENT IMAGING MATERIALS INCLUDING AN ORGANIC SILVER SALT FOR PRODUCING LABELS

(75) Inventors: Bartholomeus Cyriel Horsten, Rumst; Guy Denis Jansen, Borsbeek, both of (BE)

(73) Assignee: AGFA-Gevaert (BE)

( * ) Notice: Subject to any disclaimer, the term of this patent is extended or adjusted under 35 U.S.C. 154(b) by 0 days.

(21) Appl. No.: 09/452,063

(22) Filed: Nov. 30, 1999

Related U.S. Application Data

(60) Provisional application No. 60/118,820, filed on Feb. 5, 1999.

(30) Foreign Application Priority Data

Nov. 30, 1998 (EP) ..... 98204015

(51) Int. Cl.[7] ..... B41M 5/40

(52) U.S. Cl. ..... 503/201; 503/200; 503/202; 503/212; 503/226

(58) Field of Search ..... 503/200, 201, 503/202, 216, 226

(56) References Cited

U.S. PATENT DOCUMENTS

| | | | | |
|---|---|---|---|---|
| 3,708,378 A | | 1/1973 | Tung | 161/6 |
| 4,370,370 A | | 1/1983 | Iwata et al. | 428/40 |
| 4,943,555 A | | 7/1990 | Nakamoto et al. | 503/227 |
| 5,411,929 A | | 5/1995 | Ford et al. | 503/210 |
| 5,750,464 A | | 5/1998 | Dombrowski, Jr. et al. | 503/204 |
| 5,766,828 A | * | 6/1998 | Patel et al. | 430/350 |

FOREIGN PATENT DOCUMENTS

| | | |
|---|---|---|
| EP | 0479578 | 4/1992 |
| EP | 0656264 | 6/1995 |
| EP | 0736799 | 10/1996 |
| EP | 0754564 | 1/1997 |
| JP | 601077 | 1/1985 |
| WO | 8703541 | 6/1987 |

* cited by examiner

*Primary Examiner*—Bruce H. Hess
(74) *Attorney, Agent, or Firm*—Leydig, Voit & Mayer, Ltd.

(57) ABSTRACT

A process for using a substantially light-insensitive mono sheet direct thermal imaging material for producing a non-retro-reflective readable object attachable to a second object for information purposes, the imaging material including a support, a thermosensitive element and an attaching layer, wherein the thermosensitive element contains a substantially light-insensitive organic silver salt, a reducing agent therefore in thermal working relationship therewith, a binder and does not contain a di- or triarylmethane dye precursor compound possessing within its di- or triarylmethane structure an aryl group substituted in the ortho position to the meso carbon atom with an S-containing moiety ring-closed on the meso carbon atom selected from a thiolactone, dithiolactone and thioether moiety.

8 Claims, No Drawings

USE OF DIRECT THERMAL TRANSPARENT IMAGING MATERIALS INCLUDING AN ORGANIC SILVER SALT FOR PRODUCING LABELS

The application claims the benefit of the U.S. Provisional Application No. 60/118,820 filed Feb. 5, 1999.

FIELD OF THE INVENTION

The present invention concerns the use of substantially light-insensitive mono sheet direct thermal imaging materials for producing labels.

BACKGROUND OF THE INVENTION

Thermal imaging or thermography is a recording process wherein images are generated by the use of thermal energy. In direct thermal printing a visible image pattern is produced by image-wise heating of a recording material e.g. image signals can be converted into electric pulses and then via a driver circuit selectively transferred to a thermal print head, which consists of microscopic heat resistor elements, thereby converting the electrical energy into heat via the Joule effect. This heat brings about image formation in the thermographic material.

Label-printing by means of thermography is known with tapes on the basis of mono sheet materials such as colourless or light coloured dye precursor leuco-dye systems, as disclosed in U.S. Pat. No. 4,370,370, EP-A 479 578 and EP-A 754 564, diazo systems, as disclosed in JP 60-01077A, or two-sheet thermal dye transfer systems, such as disclosed in EP-A 656 264 and U.S. Pat. No. 4,943,555.

WO 87/03541A discloses a recording material which comprises (a) at least one di- or triarylmethane dye precursor compound possessing within its di- or triarylmethane structure an aryl group substituted in the ortho position to the meso carbon atom with an S-containing moiety ring-closed on the meso carbon atom selected from a thiolactone, dithiolactone and thioether moiety and (b) a Lewis acid material capable of opening said S-containing moiety whereby said compound is rendered colourless, which Lewis acid material can be an organic silver salt. U.S. Pat. No. 5,750,464 and U.S. Pat. No. 5,411,929A disclose refinements of the concept of WO 87/03541A in which the organic silver salt opens the S-containing moiety rendering said compound containing the S-containing moiety colourless.

U.S. Pat. No. 3,708,378 provides a single integral imaging sheet that in a single rapid operation may be converted to a label carrying the desired retro-reflective informative symbols. It discloses a light-stable heat-sensitive imaging sheet on which retro-reflective images may be rapidly defined comprising (1) a support layer, (2) a uniform continuous mono layer of retro-reflective elements disposed on one side of the support layer, and (3) an imaging layer disposed over the retro-reflective elements comprising, in uniform distribution throughout the layer, a light-stable heat-sensitive material that is rapidly chemically modified as to its light-transmitting properties by exposure to heat, the imaging layer being selected from the group consisting of (1) normally transparent light-stable layers that are adapted to be converted to transparent when exposed to heat and (2) normally opaque light-stable layers that are adapted to be converted to transparent when exposed to heat, whereby light beamed against the sheet will be retro-reflected only by retro-reflective elements exposed through the transparent areas. Examples 1 and 2 both disclose a silver behenate-based imaging layer using methyl gallate as a reducing agent therefore.

U.S. Pat. No. 3,708,378 contains no teaching about the use of organic silver salt-based materials for conventional labelling applications. The patent literature over thermographic materials for labelling applications in the intervening twenty-eight years has exclusively concerned other imaging systems mono sheet materials such as the above-mentioned leuco-dye systems.

Labels produced with mono sheet thermographic materials based on leuco-dyes have a well-known propensity to fade when exposed to light, the thermographic materials disclosed in U.S. Pat. No. 5,750,464, U.S. Pat. No. 5,411,929A and WO 87/03541A concern colour removal rather than colour formation, and thermal dye transfer systems are expensive to assemble and produce waste due to the disposal of the donor lint resulting in ecological objections.

OBJECTS OF THE INVENTION

It is therefore an object of the present invention to provide mono sheet direct thermal imaging materials for labelling applications which do not fade.

It is therefore a further object of the present invention to provide substantially light-insensitive mono sheet direct thermal imaging materials for labelling applications with excellent light stability and image tone.

Further objects and advantages of the invention will become apparent from the description hereinafter.

SUMMARY OF THE INVENTION

It has been surprisingly found that labels produced using substantially light-insensitive mono sheet direct thermal imaging materials based on organic silver salts do not fade and have excellent light stability and image tone.

The above-mentioned objects are realized by a process for using a substantially light-insensitive mono sheet direct thermal imaging material for producing a non-retro-reflective readable object attachable to a second object for information purposes, the mono sheet direct thermal imaging material including a support, a thermosensitive element and an attaching layer, wherein the thermosensitive element contains a substantially light-insensitive organic silver salt, a reducing agent therefore in thermal working relationship therewith, a binder and does not contain a di- or triarylmethane dye precursor compound possessing within its di- or triarylmethane structure an aryl group substituted in the ortho position to the meso carbon atom with an S-containing moiety ring-closed on the meso carbon atom selected from a thiolactone, dithiolactone and thioether moiety.

Preferred embodiments of the present invention are disclosed in the detailed description of the invention.

DETAILED DESCRIPTION OF THE INVENTION

Definitions

A label according to the present invention is a non-retro-reflective readable object attachable to a second object for information purposes.

A direct thermal imaging material is a material in which coloration is obtained in areas of the material to which heat is supplied either directly by an external heat source or indirectly by heat produced upon absorption of infra-red radiation in these areas of the material.

Transparent means capable of transmitting visible light without appreciable scattering.

By substantially light-insensitive is meant not intentionally light sensitive.

The descriptor aqueous in the term aqueous medium for the purposes of the present invention includes mixtures of water-miscible organic solvents such as alcohols e.g. methanol, ethanol, 2-propanol, butanol, iso-amyl alcohol etc.; glycols e.g. ethylene glycol; glycerine; N-methyl pyrrolidone; methoxypropanol; and ketones e.g. 2-propanone and 2-butanone etc. with water in which water constitutes more than 50% by weight of the aqueous medium with 65% by weight of the aqueous medium being preferred and 80% by weight of the aqueous being particularly preferred.

The encapsulated organic silver salt in a heat-responsive microcapsule disclosed in EP 736 799A whose use in the thermosensitive element of the present invention is preferably excluded has a wall which isolates the substances incorporated therein from the exterior at room temperature, but becomes permeable without being destroyed when pressure is applied or when heated. The microcapsule can be prepared by any of interfacial polymerization, internal polymerization and external polymerization.

Interfacial polymerization comprises emulsifying a core substance comprising an organic silver salt that has been dissolved or dispersed in an organic solvent in an aqueous solution having a water-soluble polymer therein and then forming a polymer wall around the emulsified oil droplets of the core substance.

A leuco-dye is a colourless or weakly coloured compound derived from a dye. Colourless or light coloured dye precursor leuco-dye systems whose use in the thermosensitive element of the present invention is excluded include leuco triarylmethane, indolyl phthalide, diphenylmethane, 2-anilinofluoran, 7-anilinofluoran, xanthene and spiro compounds such as disclosed in EP-A 754 564.

By the term "heat solvent" in this invention is meant a non-hydrolyzable organic material which is in a solid state in the recording layer at temperatures below 50° C., but becomes a plasticizer for the recording layer when thermally heated and/or a liquid solvent for the organic silver salt or the reducing agent.

Use of substantially light-insensitive mono sheet direct thermal transparent imaging materials containing an organic silver salt for the production of labels It has been surprisingly found that the image-forming behavior of substantially light-insensitive mono sheet direct thermal imaging materials based on organic silver salts deviates from that of other substantially light-insensitive mono sheet direct thermal imaging materials in that the image density and image tone are critically dependent upon the conditions applying during image formation as can be seen by comparing COMPARATIVE EXAMPLES 1 to 11 with INVENTION EXAMPLES 12 to 33. Whereas in the widely used leuco dye-containing imaging materials the image density did not vary systematically with the heating energy applied to the adjacent heating element during the thermographic development process, the so-called dot energy, the image density achieved with a substantially light-insensitive mono sheet direct thermal imaging material based on an organic silver salt appears surprisingly mainly to depend upon the heating energy applied to the adjacent heating element during the thermographic development process. Since dot energy is the product of heating power and heating pulse-length, this implies that the image density is surprisingly almost independent of the heating power. Moreover, the heating power will largely determine the temperature attained by the heating element and hence that attained by the substantially light-insensitive mono sheet direct thermal imaging material based on an organic silver salt in proximity to the heating element during the thermal development process. This means that the image density is almost independent of the temperature attained by the substantially light-insensitive mono sheet direct thermal imaging material based on an organic silver salt in proximity to the heating element during the thermal development process. Furthermore this dot energy can be supplied to one or more heating elements activated to produce the dot with a particular image density i.e. the heating power (i.e. drive voltage squared divided by the heating element resistance) applied to the one or more heating elements, in one or more heat pulses and the duration of the one or more pulses.

Above a threshold energy, INVENTION EXAMPLES 1 to 11 show that the image density increases with increasing dot energy up to a maximum image density. The dot energy corresponding to this maximum image density has been found to be dependent upon the choice of reducing agent for a particular organic silver salt, the choice of toning agent and the ratio of binder to organic silver salt in the thermosensitive element. At still higher energies the image density decreases with further increase in dot energy. For a given binder to organic silver salt ratio and given concentration of a particular reducing agent and toning agent, the image density potential of the material has been found mainly to depend upon the weight per unit area of substantially light-insensitive organic silver salt therein.

Substantially light-insensitive mono sheet direct thermal transparent imaging materials containing an organic silver salt for the production of labels The substantially light-insensitive mono sheet direct thermal imaging materials of the present invention, includes a support, a thermosensitive element and an attaching layer and in a preferred embodiment further includes a dyed or a pigmented transparent layer to provide a coloured background for the image on the label. The dyed or the pigmented transparent layer is preferably provided on the support. The substantially light-insensitive mono sheet direct thermal imaging material of the present invention are preferably transparent.

The attaching layer is, once an optional protective foil has been removed, the outermost layer on the same side of the support as the thermosensitive element or the outermost layer on the side of the support not provided with the thermosensitive element. This attaching layer provides adhesion upon contact with the surface of an object to which it is to be attached under the conditions of attachment. This object is a solid whose surface may, for example, be plastic, paper, metal, wood, glass, ceramic etc. Such adhesion is a co-operative effect between the attaching layer and the surface of the object to which it is attached and is influenced by the conditions of attachment. Therefore the choice of attaching layer is dependent upon the surface of the object to which it is to be attached, i.e. the absence of species such as particles, adsorbed solvent or water, oxidized layers, grease etc. which would inhibit the adhesion process, and the conditions under which attachment takes place e.g. the application of heat, pressure, solvent etc. This attaching layer may, for example, be a single or multi-component, cold, hot-melt or pressure resinous adhesive. The protective foil may, for example, be plastic, metallic or a glassine-based paper coated e.g. with a silicone layer.

Thermosensitive Element

The substantially light-insensitive mono sheet direct thermal imaging material used in the present invention comprises a thermosensitive element. The thermosensitive element contains a substantially light-insensitive organic silver salt, a reducing agent therefore in thermal working relationship therewith a binder and does not contain a di-or triarylmethane dye precursor compound possessing within its di- or triarylmethane structure an aryl group substituted in the ortho position to the meso carbon atom with an S-containing moiety ring-closed on the meso carbon atom selected from a thiolactone, dithiolactone and thioether moiety.

A di- or triarylmethane dye precursor compound possessing within its di- or triarylmethane structure an aryl group substituted in the ortho position to the meso carbon atom with an S-containing moiety ring-closed on the meso carbon atom selected from a thiolactone, dithiolactone and thioether moiety is disclosed in WO 87/03541 and may be represented by the formula

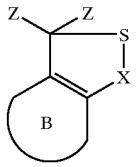

wherein X is —(C═O)—, —(C═S)— or —$CH_2$—; ring B represents a substituted or unsubstituted carbocyclic aryl ring or a heterocyclic aryl ring; and Z and Z' taken individually represent the moieties; to complete the auxochromophoric system of a diarylmethane or a triarylmethane dye when said S-containing ring is open. Furthermore, this thermosensitive element preferably excludes colourless or light coloured dye precursor leuco-dye systems and also preferably excludes encapsulated organic silver salt in a heat-responsive microcapsule.

The thermosensitive element may also comprise a layer system in which the ingredients may be dispersed in different layers, with the proviso that the substantially light-insensitive organic silver salt and the reducing agent are in thermal working relationship with one another i.e. during the thermal development process the reducing agent must be present in such a way that it is able to diffuse to the substantially light-insensitive organic silver salt particles so that reduction of the substantially light-insensitive organic silver salt can take place.

Organic Silver Salts

Preferred substantially light-insensitive organic silver salts for use in the thermosensitive element of the substantially light-insensitive mono sheet direct thermal imaging material used in the present invention, are silver salts of aliphatic carboxylic acids known as fatty acids, wherein the aliphatic carbon chain has preferably at least 12 C-atoms, which silver salts are also called "silver soaps". Combinations of different organic silver salts may also be used in the imaging materials of the present invention.

Organic Reducing Agents

Suitable organic reducing agents for the reduction of the substantially light-insensitive organic silver salts are organic compounds containing at least one active hydrogen atom linked to O, N or C, such as is the case with: catechol; hydroquinone; aminophenols; METOL™; p-phenylenediamines; alkoxynaphthols, e.g. 4-methoxy-1-naphthol described in U.S. Pat. No. 3,094,417; pyrolidin-3-one type reducing agents, e.g. PHENIDONE™; pyrazolin-5-ones; indan-1,3-dione derivatives; hydroxytetrone acids; hydroxytetronimides; hydroxylamine derivatives such as for example described in U.S. Pat. No. 4,082,901; hydrazine derivatives; and reductones e.g. ascorbic acid; see also U.S. Pat. Nos. 3,074,809, 3,080,254, 3,094,417 and 3,887,378.

The choice of reducing agent influences the thermal sensitivity of the imaging material and the gradation of the image. Imaging materials using gallates, for example, have a high gradation. In a preferred embodiment of the present invention the thermosensitive element contains a 3,4-dihydroxyphenyl compound in which a benzene ring substituted with any group in the 1-position is further substituted with hydroxy-groups in the 3- and 4-positions, the 3,4-dihydroxyphenyl compound being preferably selected from the group consisting of gallic acid derivatives, gallates, ethyl 3,4-dihydroxybenzoate, butyl 3,4-dihydroxybenzoate, 3,4-dihydroxy-benzoic acid and 3,4-dihydroxybenzonitrile. In a particularly preferred embodiment the thermosensitive element further contains a second reducing agent.

Binder

The thermosensitive element of the direct thermal transparent imaging material used in the present invention may be coated onto a support in sheet- or web-form from an organic solvent containing the binder dissolved therein or may be applied from an aqueous medium using water-soluble or water-dispersible binders.

Suitable binders for coating from an organic solvent are all kinds of natural, modified natural or synthetic resins or mixtures of such resins, wherein the organic heavy metal salt can be dispersed homogeneously or mixtures thereof.

Suitable water-soluble film-forming binders are: polyvinyl alcohol, polyacrylamide, polymethacrylamide, polyacrylic acid, polymethacrylic acid, polyethyleneglycol, polyvinylpyrrolidone, proteinaceous binders such as gelatin modified gelatins such as phthaloyl gelatin, polysaccharides, such as starch, gum arabic and dextrin and water-soluble cellulose derivatives. Suitable water-dispersible binders are any water-insoluble polymer.

As the binder to organic silver salt weight ratio decreases the gradation of the image increasing. Binder to organic silver salt weight ratios of 0.2 to 6 are preferred with weight ratios between 0.5 and 3 being particularly preferred.

The above mentioned binders or mixtures thereof may be used in conjunction with waxes or "heat solvents" to improve the reaction speed of the organic silver salt reduction at elevated temperatures.

Toning Agents

In order to obtain a neutral black image tone in the higher densities and neutral grey in the lower densities, the direct thermal transparent imaging material used in the present invention may contain one or more toning agents. The toning agents should be in thermal working relationship with the substantially light-insensitive organic silver salt and reducing agents during thermal processing. Any known toning agent from thermography or photo thermography may be used. Suitable toning agents are the phthalimides and phthalazinones within the scope of the general formulae described in U.S. Pat. No. 4,082,901 and the toning agents described in U.S. Pat. No. 3,074,809, U.S. Pat. No. 3,446,648 and U.S. Pat. No. 3,844,797. Particularly useful toning agents are the heterocyclic toner compounds of the benzoxazine dione or naphthoxazine dione type described in GB-P 1,439,478, U.S. Pat. No. 3,951,660 and U.S. Pat. No. 5,599,647.

Stabilizers and Antifoggants

In order to obtain improved shelf-life and reduced fogging, stabilizers and antifoggants may be incorporated into the substantially light-insensitive mono sheet direct thermal imaging material used in the present invention. Suitable stabilizers compounds for use in the substantially light-insensitive mono sheet direct thermal imaging material used in the present invention are represented by general formula I:

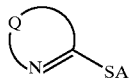

where Q are the necessary atoms to form a 5- or 6-membered aromatic heterocyclic ring, A is selected from hydrogen, a counterion to compensate the negative charge of the thiolate group or a group forming a symmetrical or an asymmetrical disulfide.

Surfactants and Dispersants

Surfactants and dispersants aid the dispersion of ingredients which are insoluble in the particular dispersion medium. The substantially light-insensitive mono sheet direct thermal imaging material used in the present invention may contain one or more surfactants, which may be anionic, non-ionic or cationic surfactants and/or one or more dispersants. Suitable dispersants are natural polymeric substances, synthetic polymeric substances and finely divided powders, e.g. finely divided non-metallic inorganic powders such as silica.

Other Ingredients

In addition to the ingredients the direct thermal transparent imaging material may contain other additives such as free fatty acids, antistatic agents, e.g. non-ionic antistatic agents including a fluorocarbon group as e.g. in $F_3C(CF_2)_6CONH(CH_2CH_2O)$—H, silicone oil, ultraviolet light absorbing compounds, white light reflecting and/or ultraviolet radiation reflecting pigments, silica, and/or optical brightening agents.

Support

The support of the direct thermal transparent imaging material used in the present invention is transparent and is preferably a thin flexible carrier made transparent resin film, e.g. made of a cellulose ester, e.g. cellulose triacetate, polypropylene, polycarbonate or polyester, e.g. polyethylene terephthalate. The support may be in sheet, ribbon or web form and subbed if needs be to improve the adherence to the thereon coated thermosensitive element. The support may be dyed or pigmented to provide a transparent coloured background for the image.

Protective Layer

In a preferred embodiment of the present invention a protective layer is provided for the thermosensitive element. In general this protects the thermosensitive element from atmospheric humidity and from surface damage by scratching etc. and prevents direct contact of printheads or heat sources with the recording layers. Protective layers for thermosensitive elements which come into contact with and have to be transported past a heat source under pressure, have to exhibit resistance to local deformation and good slipping characteristics during transport past the heat source during heating. A slipping layer, being the outermost layer, may comprise a dissolved lubricating material and/or particulate material, e.g. talc particles, optionally protruding from the outermost layer. Examples of suitable lubricating materials are a surface active agent, a liquid lubricant, a solid lubricant or mixtures thereof, with or without a polymeric binder.

Coating Techniques

The coating of any layer of the substantially light-insensitive main sheet direct thermal transparent imaging material used in the present invention may proceed by any known coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, USA. Coating may proceed from aqueous or solvent media with over coating of dried, partially dried or undried layers.

Thermographic Printing

Direct thermal imaging is carried out by the image-wise application of heat either in analogue fashion by direct exposure through an image of by reflection from an image, or in digital fashion pixel by pixel either by using an infra-red heat source, for example with a Nd-YAG laser or other infra-red laser, or by direct thermal imaging with a thermal head.

In thermal printing image signals are converted into electric pulses and then through a driver circuit selectively transferred to a thermal print head. The thermal print head consists of microscopic heat resistor elements, which convert the electrical energy into heat via Joule effect. The electric pulses thus converted into thermal signals manifest themselves as heat transferred to the surface of the thermal paper wherein the chemical reaction resulting in colour development takes place. Such thermal printing heads may be used in contact or close proximity with the recording layer. The operating temperature of common thermal printheads is in the range of 300 to 400° C. and the heating time per picture element (pixel) may be less than 1.0 ms, the pressure contact of the thermal print head with the recording material being e.g. 200–500 g/cm$^2$ to ensure a good transfer of heat.

In order to avoid direct contact of the thermal printing heads with a recording layer not provided with an outermost protective layer, the image-wise heating of the recording layer with the thermal printing heads may proceed through a contacting but removable resin sheet or web wherefrom during the heating no transfer of recording material can take place.

The image signals for modulating the laser beam or current in the micro-resistors of a thermal printheads are obtained directly or from an intermediary storage means, optionally linked to a digital image work station wherein the image information can be processed to satisfy particular needs.

Activation of the heating elements can be power-modulated or pulse-length modulated at constant power. EP-A 654 355 describes a method for making an image by image-wise heating by means of a thermal head having energizable heating elements, wherein the activation of the heating elements is executed duty cycled pulse wise. When used in thermographic recording operating with thermal printheads the imaging materials are not suitable for reproducing images with fairly large number of grey levels as is required for continuous tone reproduction. EP-A 622 217 discloses a method for making an image using a direct thermal imaging element producing improvements in continuous tone reproduction. Image-wise heating of the thermographic material can also be carried out using an electrically resistive ribbon incorporated into the material. Image- or pattern-wise heating of the thermographic material may also proceed by means of pixel-wise modulated ultra-sound.

The following examples and comparative examples illustrate the present invention. The percentages and ratios used in the examples are by weight unless otherwise indicated.

COMPARATIVE EXAMPLES 1 to 11

Leuco-dye Based Direct Thermal Imaging Material for Label Production

The label-printing apparatus used for these experiments was a thermal head printer, the thermal head having a nominal resistance of 102.6 ohms and 115 $\mu$m by 142 $\mu$m heating elements. It printed with a line time of 11.5 ms at a process speed of 7.3 mm/s, was powered by six 1.5 volt batteries and had a DC-motor driven drum transport.

BROTHER P-TOUCH TYPE™ M-K231 black on white leuco-dye-based direct thermal imaging material with an opaque white backing layer was printed with three heating pulses evenly distributed over the line time at the voltages and pulse times given in table 1. The image density $D_{vis}$ and the CIELAB L*, a* and b* values determined in refection according to ASTM Norm E308 of the resulting prints are given table 1 below.

TABLE 1

| Comparative example | Printing conditions | | | Print characteristics | | | |
|---|---|---|---|---|---|---|---|
| | dot energy | printhead voltage | pulse-length | | | | |
| nr | [mJ/mm$^2$] | [V] | [ms] | $D_{vis}$ | L* | a* | b* |
| 1 | 49.2 | 3.95 | 1.76 | 1.51 | 20.39 | −0.10 | −5.03 |
| 2 | 55.6 | 4.20 | 1.76 | 1.57 | 18.88 | 0.89 | −5.36 |
| 3 | 56.2 | 3.95 | 2.01 | 1.51 | 20.33 | 0.73 | −5.63 |
| 4 | 63.5 | 4.20 | 2.01 | 1.57 | 18.81 | 0.81 | −5.06 |
| 5 | 64.2 | 3.95 | 2.30 | 1.55 | 19.37 | 0.61 | −5.33 |
| 6 | 68.2 | 4.65 | 1.76 | 1.58 | 18.41 | 0.73 | −4.79 |
| 7 | 72.6 | 4.20 | 2.30 | 1.60 | 17.97 | 0.72 | −4.64 |
| 8 | 77.8 | 4.65 | 2.01 | 1.59 | 18.31 | 0.45 | −4.53 |
| 9 | 83.4 | 4.20 | 2.64 | 1.56 | 19.04 | 0.33 | −4.58 |
| 10 | 89.0 | 4.65 | 2.30 | 1.58 | 18.39 | 0.28 | −4.75 |
| 11 | 95.4 | 4.20 | 3.02 | 1.65 | 16.73 | 0.42 | −3.80 |
| 12 | 102.2 | 4.65 | 2.64 | 1.60 | 17.86 | 0.60 | −4.70 |
| 13 | 109.3 | 4.20 | 3.46 | 1.65 | 16.81 | −0.01 | −3.38 |
| 14 | 116.9 | 4.65 | 3.02 | 1.65 | 16.73 | 0.49 | −4.26 |
| 15 | 134.0 | 4.65 | 3.46 | 1.64 | 16.99 | 0.45 | −4.70 |

Results show a possible marginal increase in $D_{vis}$ and no significant dependence of a*- and b*- values upon dot energy.

Exposure of Prints to Artificial Sunlight in a Lightfastness Test

The lightfastness of a print produced with the BROTHER P-TOUCH TYPE™ M-K231 leuco dye-based direct thermal imaging material was evaluated according to DIN 54 024 of August 1983 for the determination of lightfastness of colourings and prints, which is equivalent to the ISO-document 38/1 N 767, pages 59–73, with an Atlas Material Testing Technology BV, D-63558 Gelnhausen, Germany, SUNTEST™ CPS apparatus. In this test the print is exposed to artificial sunlight through a glass filter together with standardized pigmented cloth samples and exposed to different doses of artificial sunlight as determined by the fading of the standardized pigmented cloth samples and expressed as numbers on the International Wool-scale. The background density, $D_{min}$, maximum density, $D_{max}$, and CIELAB a*- and b*-values of the black print with respect to the white background of the material determined after exposure to different International Wool-scale exposures are summarized in table 2.

TABLE 2

| | $D_{max}$ | a* | b* | $D_{min}$ | a* | b* |
|---|---|---|---|---|---|---|
| Image characteristics prior to sunlight exposure | 1.602 | 2.21 | −6.78 | 0.083 | −1.72 | 3.31 |
| Image characteristics after an exposure of 2 according to the IWS* | 1.591 | 2.04 | −7.08 | 0.087 | −1.40 | 4.35 |
| Image characteristics after an exposure of 4 according to the IWS* | 1.558 | 2.92 | −7.59 | 0.096 | −0.92 | 10.23 |
| Image characteristics after an exposure of 5 according to the IWS* | 1.040 | 18.73 | −4.33 | 0.144 | 1.00 | 24.29 |
| Image characteristics after an exposure of 5+ according to the IWS* | 1.116 | 16.37 | −2.06 | 0.146 | 1.06 | 24.74 |

*International Wool-scale

From table 2 it is evident that at exposures below 6 on the International Wool-scale, there is an appreciable decrease in $D_{max}$ associated with a strong increase in its CIELAB a*-value indicating a shift in the image tone in reflection to the red, which is visible as an increasingly brown image tone, and an increase in $D_{min}$ associated with a strong increase in its CIELAB b*-value, indicating a shift in the image tone of the background to the yellow.

INVENTION EXAMPLES 1 to 11

Preparation of the Thermosensitive Element

The subbed 63 $\mu$m thick polyethylene terephthalate support was doctor blade-coated with a composition containing 2-butanone as solvent/dispersing medium so as to obtain thereon, after drying for 1 hour at 50° C., a thermosensitive element with the composition:

| | |
|---|---|
| Silver behenate | 3.379 g/m$^2$ |
| PIOLOFORM ™ LL4160, a polyvinyl butyral from WACKER CHEMIE | 3.379 g/m$^2$ |
| BAYSILON ™ MA, a silicone oil from BAYER | 0.128 g/m$^2$ |
| 7-(ethylcarbonato)benzo[e] [1,3]oxazine-2,4-dione, a toning agent | 0.189 g/m$^2$ |
| ethyl 3,4-dihydroxybenzoate, a reducing agent | 0.738 g/m$^2$ |
| tetrachlorophthalic anhydride | 0.203 g/m$^2$ |
| 3'-decanoylamino-1-phenyl-1H-tetrazole-5-thiol* | 0.073 g/m$^2$ |
| TINUVIN ™ 320 from CIBY-GEIGY | 0.129 g/m$^2$ |
| DESMODUR ™ N100, a hexamethylene diisocyanate from BAYER | 0.348 g/m$^2$ |

*

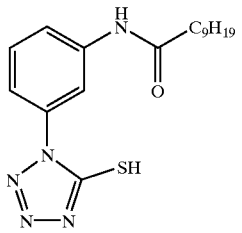

Over coating of Thermosensitive Element with a Protective Layer

The above-described thermosensitive element was overcoated with a protective layer with the composition:

| | |
|---|---|
| PIOLOFORM ™ LL4160, a polyvinyl butyral from WACKER CHEMIE | 1.539 g/m$^2$ |
| BAYSILON ™ MA, a silicone oil from BAYER | 0.006 g/m$^2$ |
| MICRODOL ™ SUPER, a talc from Norwegian Talc AS | 0.092 g/m$^2$ |
| TINUVIN ™ 320 from CIBA-GEIGY | 0.229 g/m$^2$ |
| TEGOGLIDE ™ 410 from Goldschmidt | 0.02 g/m$^2$ |
| DESMODUR ™ N100, a hexamethylene diisocyanate from BAYER | 0.154 g/m$^2$ |

Thermographic Printing

The thermographic printer used in these experiments was also a thermal head printer, but had a thermal head with a nominal resistance of 1850 ohms, had 85 $\mu$m by 85 $\mu$m heating elements, printed with a line time of 11.5 ms and the thermographic material was transported at a process speed of 7.36 mm/s. The number of heating pulses, print head voltages and pulse times were completely variable.

The above-described direct thermal material was printed with a single pulse per line time and at the voltages and pulse times given in table 3 below. The image density $D_{vis}$ and the CIELAB L*, a* and b* values determined in refection according to ASTM Norm E308 of the resulting prints are given in table 3 below.

The experiments of INVENTION EXAMPLES 1 to 11 show an increase in image density $D_{vis}$ with increasing dot energy. However, the $D_{vis}$ value appears to stabilize and then decrease at the highest dot energies used. The L* value, a measure of the transmission of the layer decreases with increasing dot energy consistent with the increase in $D_{vis}$.

TABLE 3

| Invention example | Printing conditions | | | Print characteristics | | | |
|---|---|---|---|---|---|---|---|
| | dot energy | printhead voltage | pulse-length | | | | |
| number | [mJ/mm$^2$] | [V] | [ms] | $D_{vis}$ | L* | a* | b* |
| 1 | 37.9 | 11.5 | 3.83 | 0.01 | 99.23 | −0.04 | 0.92 |
| 2 | 41.7 | 11.5 | 4.21 | 0.06 | 94.84 | 0.18 | 2.37 |
| 3 | 45.5 | 11.5 | 4.60 | 0.22 | 81.73 | 0.62 | 6.02 |
| 4 | 49.3 | 11.5 | 4.98 | 0.52 | 61.90 | 0.98 | 9.34 |
| 5 | 53.0 | 11.5 | 5.36 | 0.90 | 41.99 | 1.70 | 11.15 |
| 6 | 56.9 | 11.5 | 5.75 | 1.42 | 22.89 | 2.89 | 9.70 |
| 7 | 60.6 | 11.5 | 6.13 | 1.79 | 13.34 | 2.90 | 4.69 |
| 8 | 64.4 | 11.5 | 6.51 | 1.86 | 11.79 | 1.69 | 0.33 |
| 9 | 68.2 | 11.5 | 6.89 | 1.98 | 9.44 | 1.13 | −1.37 |
| 10 | 72.0 | 11.5 | 7.28 | 1.98 | 9.43 | 0.95 | −1.35 |
| 11 | 75.8 | 11.5 | 7.66 | 1.89 | 11.20 | 0.76 | −2.00 |

Colour neutrality on the basis of CIELAB-values corresponds to a* and b* values of zero, with a negative a*-value indicating a greenish image-tone becoming greener as a* becomes more negative, a positive a*-value indicating a reddish image-tone becoming redder as a* becomes more positive, a negative b*-value indicating a bluish image-tone becoming bluer as b* becomes more negative and a positive b*-value indicating a yellowish image-tone becoming more yellow as b* becomes more positive.

The decrease in a* and b* values with increasing dot energy to values near zero for the highest dot energies used thus indicates that the image became more neutral with increasing dot energy.

INVENTION EXAMPLES 12 to 33

Direct Thermal Transparent Imaging Material

The direct thermal transparent imaging material used in the experiments of INVENTION EXAMPLES 12 to 33 was produced by coating the thermosensitive element overcoated with a protective layer used in INVENTION EXAMPLES 1 to 11 and coating the opposite side of the support to that coated with the thermosensitive element and its protective layer sequentially with a 5.5 g/m$^2$ coating of a white acrylic water-based ink pigmented with titanium dioxide having an optical density of 0.38 and over coating with a white pressure sensitive water-based dispersion to a coating weight of 26 g/m$^2$, the two layers together having an optical density of 0.65. The second layer was then pressure laminated with the silicone-coated side of 65 g/m$^2$ glassine-based paper coated with a silicone layer, which acts as a release foil.

Printing with a Thermographic Label-printing Apparatus

The label-printing apparatus used for the printing experiments of COMPARATIVE EXAMPLES 1 to 11 was used in the printing experiments of INVENTION EXAMPLES 12 to 33 in which a direct thermal transparent imaging material produced as described above was printed with three heating pulses evenly distributed over the line time at the voltages and pulse times given in table 4. The image density $D_{vis}$ and the CIELAB L*, a* and b* values determined in refection according to ASTM Norm E308 of the resulting prints are given in table 4 below.

The results are arranged in the order of the dot energies used, independent of the heating power (quadratically dependent upon print head voltage) and therefore of the temperature attained by the heating element and hence that obtained by the material local thereto. These results are surprising in two ways: in contrast to INVENTION EXAMPLES 1 to 11, the image density decreased with increase dot energy and furthermore despite considerable variations in temperature during the thermal development process due to the different heating powers used in the experiments of INVENTION EXAMPLES 12 to 33, the image density, $D_{vis}$, was found to be mainly dependent upon the dot energy applied, decreasing with increasing dot energy.

Furthermore, L*, a* and b* were also found to be dependent upon the dot energy, L* increasing with increasing dot energy, indicating decreasing optical density, and a* and b* increasing with increasing dot energy from values in the region of zero indicating colour neutrality at lower dot energies to increasingly less neutral colour tone with increasing dot energy.

TABLE 4

| Invention example | Printing conditions | | | Print characteristics | | | |
|---|---|---|---|---|---|---|---|
| | dot energy | printhead voltage | pulse-length | | | | |
| number | [mJ/mm$^2$] | [V] | [ms] | $D_{vis}$ | L* | a* | b* |
| 12 | 63.7 | 4.20 | 1.76 | 1.93 | 10.39 | −0.04 | 3.87 |
| 13 | 72.3 | 4.20 | 2.01 | 2.15 | 6.34 | 0.81 | −0.98 |

TABLE 4-continued

| Invention example number | Printing conditions: dot energy [mJ/mm²] | printhead voltage [V] | pulse-length [ms] | Print characteristics: $D_{vis}$ | L* | a* | b* |
|---|---|---|---|---|---|---|---|
| 14 | 77.8 | 4.65 | 1.76 | 1.97 | 9.54 | 1.70 | −0.14 |
| 15 | 82.7 | 4.20 | 2.30 | 1.95 | 9.98 | 1.02 | −0.62 |
| 16 | 88.8 | 4.65 | 2.01 | 1.77 | 13.88 | 3.45 | 1.26 |
| 17 | 94.9 | 4.20 | 2.64 | 1.74 | 14.46 | 2.98 | 1.27 |
| 18 | 97.4 | 5.20 | 1.76 | 1.65 | 16.64 | 8.89 | 5.00 |
| 19 | 101.7 | 4.65 | 2.30 | 1.60 | 18.00 | 6.05 | 3.53 |
| 20 | 109.0 | 4.20 | 3.02 | 1.64 | 16.90 | 9.95 | 7.09 |
| 21 | 110.8 | 5.20 | 2.01 | 1.52 | 20.17 | 10.38 | 6.89 |
| 22 | 116.4 | 4.65 | 2.64 | 1.49 | 20.97 | 11.56 | 7.56 |
| 23 | 124.9 | 4.20 | 3.46 | 1.58 | 18.52 | 16.04 | 13.45 |
| 24 | 127.4 | 5.20 | 2.30 | 1.50 | 20.59 | 19.18 | 14.52 |
| 25 | 133.5 | 4.65 | 3.02 | 1.50 | 20.71 | 18.20 | 14.52 |
| 26 | 136.6 | 5.20 | 2.47 | 1.41 | 23.42 | 18.00 | 12.76 |
| 27 | 145.7 | 5.20 | 2.64 | 1.25 | 28.30 | 17.29 | 9.70 |
| 28 | 153.1 | 4.65 | 3.46 | 1.36 | 24.83 | 18.14 | 12.07 |
| 29 | 155.5 | 5.20 | 2.82 | 1.23 | 29.00 | 20.77 | 12.14 |
| 30 | 167.2 | 5.20 | 3.02 | 1.13 | 32.84 | 14.02 | 9.14 |
| 31 | 178.2 | 5.20 | 3.23 | 1.00 | 37.69 | 13.86 | 13.27 |
| 32 | 191.1 | 5.20 | 3.46 | 0.95 | 39.80 | 13.06 | 11.07 |
| 33 | 204.5 | 5.20 | 3.70 | 0.86 | 43.94 | 11.81 | 17.49 |

Exposure of Prints to Artificial Sunlight in a Lightfastness Test

A print produced with the organic silver salt-containing thermographic material was exposed to artificial sunlight through a glass filter in an Atlas Material Testing Technology BV, SUNTEST™ CPS apparatus according to DIN 54 004. The changes in the background density, $D_{min}$, the maximum density, $D_{max}$, and CIELAB a*- and b*-values with respect to the white background of the material expressed in terms of particular UV-light doses expressed as numbers on the International Wool scale are summarized in table 5.

TABLE 5

| | $D_{max}$ | a* | b* | $D_{min}$ | a* | b* |
|---|---|---|---|---|---|---|
| Image characteristics prior to sunlight exposure | 1.805 | 12.87 | 4.42 | 0.109 | −0.90 | 9.67 |
| Image characteristics after an exposure of 4 according to the IWS* | 1.862 | 11.26 | 2.88 | 0.139 | −0.51 | 10.34 |
| Image characteristics after an exposure of 7 according to the IWS* | 1.845 | 11.92 | 2.61 | 0.167 | 0.85 | 16.26 |

*International Wool-scale

From table 5 it is evident that even at exposures of 7 on the International Wool-scale, there is no significant change in $D_{max}$ or its CIELAB a*- and b*-values, i.e. there is no fading or changes in the image tone, and the increase in $D_{min}$ is appreciably lower and the increase in its CIELAB b*-value much less pronounced than in the case of the BROTHER P-TOUCH TYPE™ M-K231 leuco dye-based direct thermal imaging material.

This demonstrates that using thermographic materials based upon organic silver salts have the advantages over the conventionally used leuco dye-based direct thermal imaging materials of no fading or changes in the image tone in $D_{max}$ and reduced $D_{min}$ increase and background discoloration upon exposure to artificial sunlight.

Having described in detail preferred embodiments of the current invention, it will now be apparent to those skilled in the art that numerous modifications can be made therein without departing from the scope of the invention as defined in the following claims.

What is claimed is:

1. A process for using a substantially light-insensitive mono sheet direct thermal imaging material for producing a non-retro-reflective readable object attached to a second object for information purposes, said imaging material including a support, a thermosensitive element and an attaching layer, wherein said thermosensitive element contains a substantially light-insensitive organic silver salt, a reducing agent therefore in thermal working relationship therewith, a binder and does not contain a di- or triarylmethane dye precursor compound possessing within its di- or triarylmethane structure an aryl group substituted in the ortho position to the meso carbon atom with an S-containing moiety ring-closed on the meso carbon atom selected from a thiolactone, dithiolactone and thioether moiety, wherein said process comprises contacting the surface of said second object with said attaching layer of said imaging material thereby adhering said imaging material to said second object.

2. Process according to claim 1, wherein said imaging material is transparent.

3. Process according to claim 1, wherein said imaging material further includes a dyed or a pigmented transparent layer.

4. Process according to claim 3, wherein said support is provided with said dyed or said pigmented transparent layer.

5. Process according to claim 1, wherein said substantially light-insensitive organic silver salt is a silver salt of an organic carboxylic acid.

6. Process according to claim 1, wherein said reducing agent is a 3,4-dihydroxyphenyl compound.

7. Process according to claim 6, wherein said 3,4-dihydroxyphenyl compound is selected from the group consisting of gallic acid derivatives, gallates, ethyl 3,4-dihydroxybenzoate, butyl 3,4-dihydroxybenzoate, 3,4-dihydroxy-benzoic acid and 3,4-dihydroxybenzonitrile.

8. Process according to claim 1, wherein said thermosensitive element is provided with a protective layer.

* * * * *